US005440762A

United States Patent [19]

Schill

[11] Patent Number: 5,440,762

[45] Date of Patent: Aug. 15, 1995

[54] NURSING COVER AND METHOD OF MAKING SAME

[76] Inventor: Lynley Schill, P.O. Box 3240, Silverdale, Wash. 98383

[21] Appl. No.: 144,282

[22] Filed: Oct. 28, 1993

[51] Int. Cl.[6] ..... A41D 1/20

[52] U.S. Cl. ..... 2/104; 2/48; 2/243.1

[58] Field of Search ..... 2/46, 48, 49.1, 50, 2/51, 52, 15, 206, 207, 171.3, 88, 174, 273, 275, 105, 106, 243.1, 91, 912, 913, 914, 915, 69, 69.5

[56] References Cited

U.S. PATENT DOCUMENTS

| | | | |
|---|---|---|---|
| 970,175 | 9/1910 | Brooks | 2/273 |
| 2,344,169 | 3/1944 | Risser | 2/48 |
| 3,042,931 | 7/1962 | Sawyer | 2/88 |
| 3,123,035 | 3/1964 | Jamison | 2/275 |
| 4,295,230 | 10/1981 | Blodgett | 2/275 X |
| 4,426,740 | 1/1984 | Reverberi | 2/88 X |
| 4,698,854 | 10/1987 | Slimmon | 2/48 X |
| 4,774,726 | 10/1988 | Garrett | 2/105 |
| 4,964,172 | 10/1990 | Bollard | 2/104 |
| 5,008,960 | 4/1991 | Hemming | 2/104 |

*Primary Examiner*—Jeanette E. Chapman
*Attorney, Agent, or Firm*—Paul Griffiths

[57] ABSTRACT

A nursing shawl having a crinoline portion, a tail portion and a securing means. Said crinoline is self-supporting due to a plurality of pleats formed therein. The pleats allow the crinoline to fold down into a compact stack of material which is easily stored in a purse or pocket. One end of the crinoline is sewn together preventing the pleats from separating while the other end is openable, thereby allowing it to be opened up like a paper fan. The sewn end is also sewn to a weighted tail that holds the shawl in place over a women's shoulder while in use. The shawl provides a tent-like structure under which a baby can be discretely nursed in a public location.

1 Claim, 2 Drawing Sheets

NURSING COVER AND METHOD OF MAKING SAME

TECHNICAL FIELD

This invention relates to an article for use by a woman while nursing her baby. More particularly, this invention relates to a nursing shawl which acts as a privacy screen providing a nursing mother with a discreet method of nursing her baby while in a public setting.

BACKGROUND ART

In recent years there has been a resurgence of mothers nursing (breast feeding) their babies. Since women quite often find themselves in a public setting when their baby needs to be fed, they face the problem of privacy and/or how to be discreet.

The nursing mother usually has several choices. She may choose to attempt to nurse her baby in a rest-room, which are often brightly lit, noisy, and apt to be less than clean. A mother may also choose to return to her automobile, if it is nearby, however this may not be practical depending on the season, that is hot in the summer and cold in the winter, not to mention rain or snow. Another solution is to use a baby blanket or diaper to attempt to cover the baby and the mother to provide some privacy. This solution however usually leads to the baby not having sufficient air or pulling the blanket or diaper off exposing the mother.

There are other times, such as when the mother is in an airport or traveling by air, and in restaurants, when it is not easy to get up from their seat and go to a restroom, when the mother would like to have a discreet method of nursing her baby. The solutions discussed above all have a myrid of problems associated therewith, some of which have been discussed, many more of which have not.

A solution developed by the present inventor included the use of a shawl having a pleated portion and a tail weighted with sand. The pleated portion was constructed of material having a fiber content of 100% cotton. The construction described above caused several problems. The pleated portion of the shawl would lose its shape and the pleats would disappear after several washings. The sand in the tail would move from pocket to pocket within the tail ending up in one lump in a pocket of the tail thereby causing somewhat of a thud against the mother's back when she tossed it over her shoulder.

Therefore, it is an object of the present invention to provide a nursing shawl that retains its function despite numerous washing and will not change through use increasing the risk of injury to the user.

SUMMARY OF THE INVENTION

The nursing shawl of the present invention comprises a crinoline sized to effectively conceal a baby while it is being nursed by a mother. The crinoline includes a plurality of pleats, said pleats allowing said crinoline fold in an accordion-like fashion forming a compact bundle of fabric. A secured end of the crinoline holds said pleats together in their folded condition while a second end is openable, whereby in use the crinoline opens up similar to a folding paper fan. A weighted tail is attached to the secured end of the crinoline. In use, the weighted tail is placed over a woman's shoulder, on the same side (right or left) the woman is going to breast feed from, and the openable end of the crinoline is fanned out over the mother's chest and lap providing a tent-like structure under which the baby can nurse. Since the crinoline is self-supporting, it forms a tented area which does not collapse around the baby or the mother's breast, allowing plenty of air around the baby's head and also preventing the crinoline from getting between the baby and the mother.

The crinoline of the present invention is made self-supporting by the use of pleats. In order to allow the crinoline to retain the pleats over many washing, the crinoline is made from a cotton-poly or poly-cotton blend of fabric. This pleated construction also allows the crinoline to be folded neatly into a small bundle which is then folded upon itself and tied to the tail by use of a ribbon attached to the tail. This provides a neat compact package which can be easily carried in a purse, diaper bag or pocket. In order to prevent the material from unraveling and also to provide for a more compact folded condition, the openable end and sides of the crinoline are finished by use of an over-lock stitch. In order to prevent the migration of the weighting material within the tail, cloth covered metallic squares are sewn into individual pockets thereby providing an evenly distributed weighting system within the tail.

BRIEF DESCRIPTION OF THE DRAWINGS

In the drawings, like reference numerals and characters refer to like parts throughout various views, and wherein.

BEST MODE FOR CARRYING OUT THE INVENTION

Figure 1:
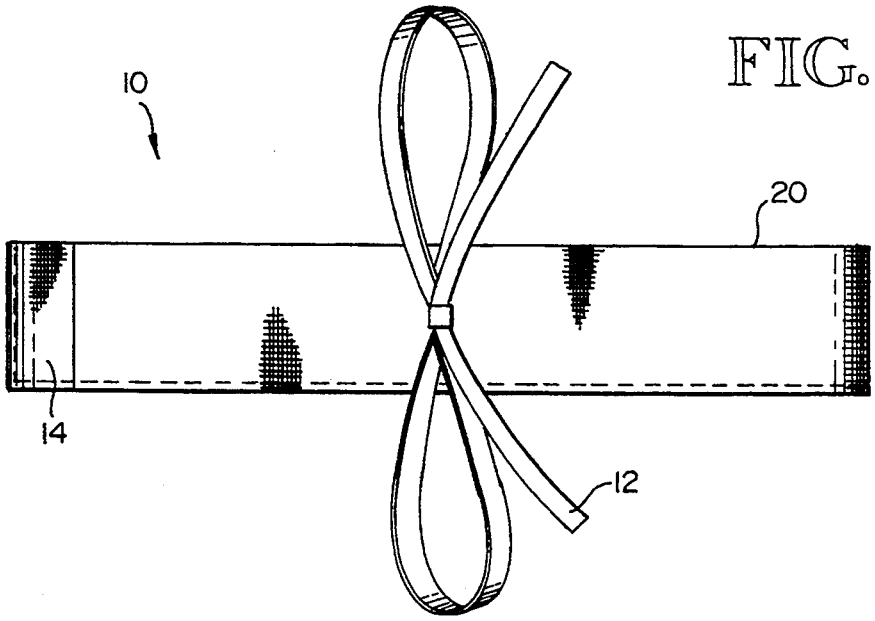
FIG. 1 is a top view of the present invention shown in its folded condition.
Figure 2:
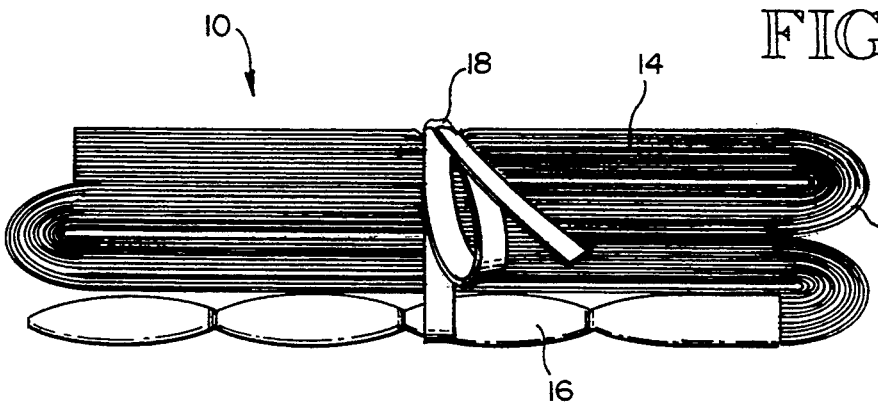
FIG. 2 is a front view of the present invention shown in its folded condition.

Referring now to FIG. 1, an accessory for use as a nursing shawl 10 is shown in its folded or stored condition. A retaining means 12, such as a ribbon or the like is used to hold the folded shawl into a compact bundle for storage. FIG. 2 shows the three main elements of nursing shawl 10. A crinoline 14, shown folded upon itself several times, is attached to a weighted tail 16. A ribbon 18 is attached to tail 16 and is used to hold the crinoline 14 and tail 16 in a folded condition for storage.

Description of Crinoline

Crinoline 14 is defined herein as a piece of fabric that is of itself, in the way it is formed, or by an associated structure, self-supporting. Any fabric or means for stiffening the fabric may be used. It is the pleats 20 that give the present invention sufficient strength to be self-supporting. In the preferred embodiment, a poly-cotton or cotton-poly blend is used due to its inherent ability to hold a pleat longer than other fabrics. It has been found that the best blend for retaining pleats is in the range of poly-cotton 70/30 to poly-cotton 50/50. The present invention has crinoline 14 pleated on a pleating machine by a manufacturer, Pleats Plus, 350 Florida Street, San Francisco, Calif. 94110. After crinoline 14 is pleated, an overlock stitch is used on sides 22 and openable end 24. Crinoline 14 is thirty-two inches in length and thirty-six inches in width.

The pleats 20 are formed by folding the fabric in an accordion-like fashion. Fold lines 21 can be spaced apart in any convenient dimension. In preferred form, the distance between fold lines 21 is in the range from one inch to three inches with one and one-half inch being preferred.

Description of the Tail

Figure 5:
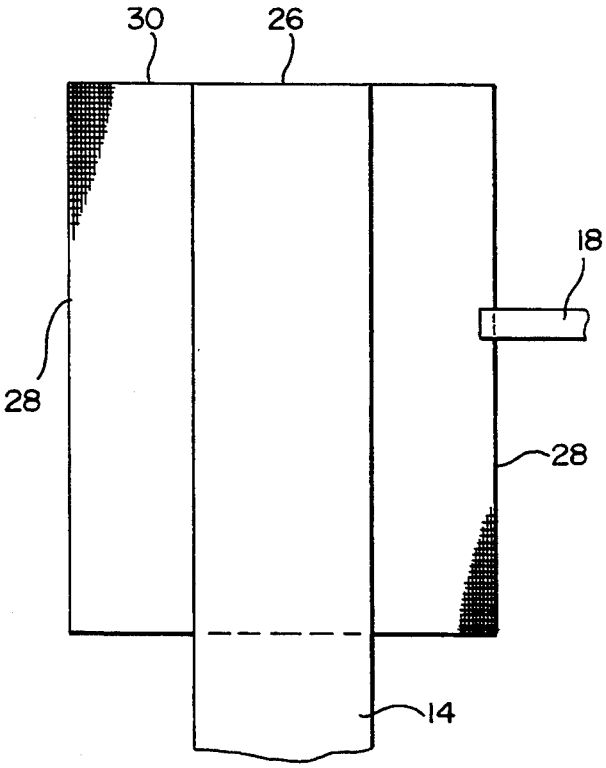
FIG. 5 is a view showing a first step in the construction of the tail and how it is attached to a secured end of a crinoline.

Tail 16 is formed and attached to crinoline 14 by laying the finish side of the piece of material toward a secured end 26 of crinoline 14 as shown in FIG. 5. In preferred form, tail 16 is made from a quilted material and is nine inches by 13 inches. Ribbon 18 is folded in half width the fold laid within the edge of tail 16 before sewing the open edge 28 of the tail. Tail 16 fabric is wrapped around secured end 26 with the open edge 28 being sewn together, forming a tube around secured end 26 of crinoline 14. Top portion 30 of tail 16 sewn to secured end 26, thereby forming an inside or blind seem between secured end 26 of crinoline 14 and top portion 30 of tail 16.

Figure 6:
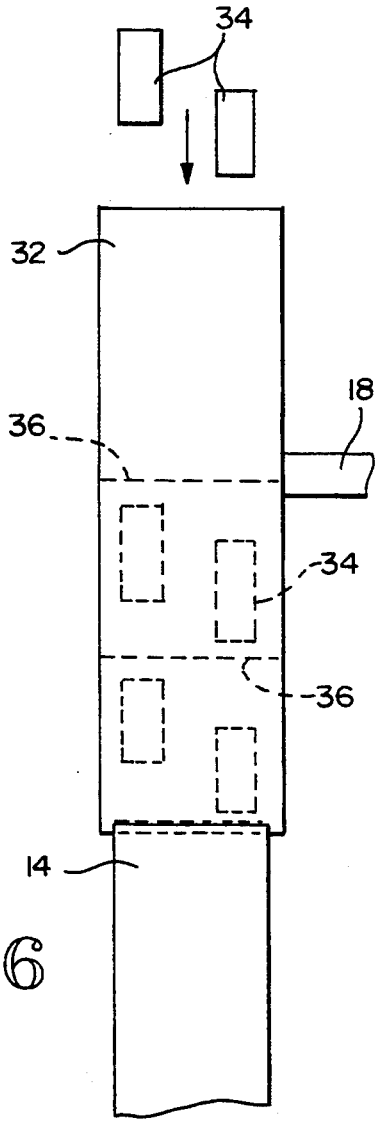
FIG. 6 is a view depicting how a solid weighting means is inserted into the tail portion and secured therein.

Tail 16 is then turned inside out thereby forming a tube 32 as shown in FIG. 6. Tail 16 is then weighted with solid weights 34 which are preferably cloth coated lead drapery weights. In preferred form, two ounce cloth covered drapery weights 34 are inserted into tube 32 and then tube 32 is sewn closed by pocket seam 36 in such a way as to create four evenly sized pockets, each containing two two ounce weights.

Figure 4:
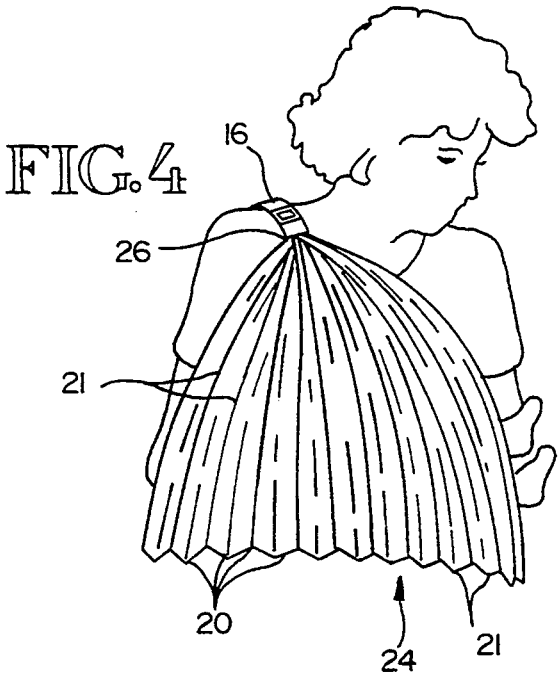
FIG. 4 is a depiction of the present invention in use.

Tail 16 has a finished width that is approximately equal to the width of pleats 20. This sizing of tail 16 is advantageous since tail 16 is hence narrow enough to fit between a user's neck and the top of their shoulder joint, as shown in FIG. 4. This helps ensure that the shawl 10 stays in place during use.

Using the Accessory

Figure 3:
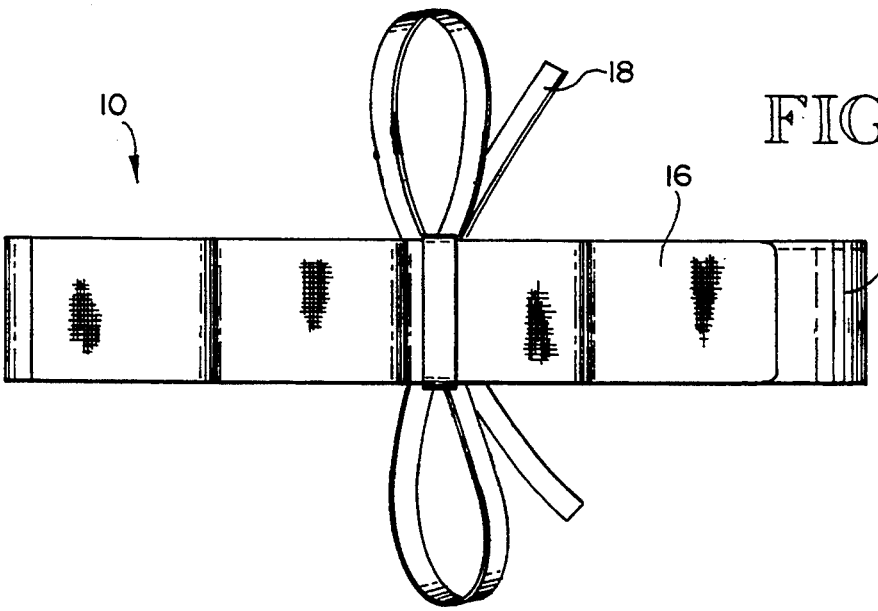
FIG. 3 is a bottom view of the present invention shown in its folded condition.

From the folded condition shown in FIGS. 1–3, crinoline 14 is unfolded, in an according-like fashion, and then weighted tail 16 is placed over the nursing mother's shoulder as shown in FIG. 4. The crinoline is then fanned out with pleats 20 providing the stiffness to form a tent-like structure over the woman's breast and the baby's head and shoulders. After nursing, the crinoline folds back into its bundle easily due to the pleats 20, with their accordion-like action, and ribbon 18 is then tied around crinoline 14 and tail 16 returning the nursing shawl 10 to its stored condition. The over-lock stitch used on sides 22 and openable end 24 allow shawl 10 to fold down into a more compact bundle than if other edge finishing methods were used.

I claim:

1. A method of constructing an accessory for discretely nursing a baby comprising the steps of:

forming a rectangular sheet of fabric; pleating said sheet of fabric such that a compact stack is formed; stitching a first side edge, a second side edge and a bottom edge of said sheet; forming a smaller rectangular piece of fabric from a larger sheet of fabric; wrapping said smaller piece of fabric around a top edge of the pleated fabric, with the pleated fabric in a stacked condition, with the finished side of smaller piece of fabric toward said pleated fabric; sewing said top edge of pleated fabric to a edge of said smaller piece of fabric; sewing a long edge of said smaller piece of fabric; turning said smaller piece of fabric inside out forming a tube having an open end, and a corresponding end; and inserting solid weights into said tube, sewing across said tube thereby forming pockets containing said weights.

* * * * *